US005711714A

United States Patent [19]

Daigle

[11] Patent Number: 5,711,714

[45] Date of Patent: Jan. 27, 1998

[54] ADD-ON-HAND-POWERED SWINGING MECHANISM FOR A PORCH SWING OR THE LIKE

[76] Inventor: Robert J. Daigle, 2408 Elizabeth St., Thibodaux, La. 70301

[21] Appl. No.: 692,717

[22] Filed: Aug. 6, 1996

[51] Int. Cl.[6] ..... A63G 9/18

[52] U.S. Cl. ..... 472/123; 472/118

[58] Field of Search ..... 472/118, 121, 472/122, 123, 125

[56] References Cited

U.S. PATENT DOCUMENTS

| | | | |
|---|---|---|---|
| 372,117 | 10/1887 | Carmody | 472/123 |
| 1,238,920 | 9/1917 | Jochumsen . | |
| 1,538,828 | 5/1925 | Lammermann . | |
| 1,748,353 | 2/1930 | Kuchera . | |
| 3,090,273 | 5/1963 | Fox | 472/123 |
| 3,480,272 | 11/1969 | Ziebart | 272/33 |
| 3,889,944 | 6/1975 | Sapienza | 472/122 |

*Primary Examiner*—Kien T. Nguyen

*Attorney, Agent, or Firm*—Joseph N. Breaux

[57] ABSTRACT

An add-on hand-powered swinging mechanism for a porch swing or the like including an extension bar securable to a fixed surface adjacent the existing porch swing at one end thereof and having a pulley connection mechanism at a second end thereof; a pulley assembly, detachably mountable to an end of the extension bar, including an extension bar connecting mechanism and a pulley wheel rotatably mounted within a pulley bracket; a cable assembly including a handle member, a cable guide having a mechanism for securing the cable guide to the back of the existing porch swing, and a cable having a first end secured to the handle member, a central section positionable through the cable guide mechanism and a second end split into two rope members, each rope member including a rope member attaching mechanism for attaching each rope mechanism to the back of the existing porch swing. In a preferred embodiment the swing mechanism further includes a cable length adjustment mechanism to allow the user to adjust the length of the cable member and thereby adjust the height of the handle member to a desired level.

20 Claims, 2 Drawing Sheets

ADD-ON-HAND-POWERED SWINGING MECHANISM FOR A PORCH SWING OR THE LIKE

TECHNICAL FIELD

The present invention relates to devices for driving porch swings and more particularly to an add-on hand-powered swinging mechanism for a porch swing that has an extension bar mountable to a surface adjacent the porch swing, a pulley assembly removably mounted to the extension bar, a cable assembly having a first end in connection with a handle and a second end split into two separate rope members that are both threaded through a centrally positionable cable guide and each secured on either side of the swing at a location on either side of the cable guide with its own securing mechanism.

BACKGROUND ART

Porch swings and the like can provide hours of pleasure. However, some individuals because of short legs or the loss of a leg through accident or amputation are unable to provide the required swinging force with their legs and, thus, are unable to enjoy the pleasure of sitting and swinging on the porch swing. It would be a benefit to these individuals to have a porch swing that could be swung without requiring the use of the users feet and legs. It would be a further benefit to have a hand-powered swinging mechanism that could be easily mounted to an existing porch swing that allowed the user to swing the porch swing by pulling on a rope or cable. Because the position of the rope or cable may be uncomfortable for some users, it would be a still further benefit to have a hand-powered swinging mechanism for a porch swing or the like that included a cable length adjustment mechanism to allow the user to conveniently position a handle secured to the rope or cable at a comfortable height.

GENERAL SUMMARY DISCUSSION OF INVENTION

It is thus an object of the invention to provide an add-on hand-powered swinging mechanism for a porch swing or the like that can be easily installed on an existing porch swing to allow the porch swing to be swung without requiring the use of the users feet and legs.

It is a further object of the invention to provide an add-on hand-powered swinging mechanism for a porch swing or the like that is easily mounted to an existing porch swing and that allows the user to swing the porch swing by pulling on a rope or cable.

It is a still further object of the invention to provide an add-on hand-powered swinging mechanism for a porch swing or the like that includes a cable length adjustment mechanism to allow the user to conveniently position a handle secured to the rope or cable at a comfortable height.

It is a still further object of the invention to provide an add-on hand-powered swinging mechanism for a porch swing or the like that accomplishes all or some of the above objects in combination.

Accordingly, an add-on hand-powered swinging mechanism for a porch swing or the like is provided. The swinging mechanism comprises an extension bar securable to a fixed surface adjacent the existing porch swing at one end thereof and having a pulley connection mechanism at a second end thereof; a pulley assembly, detachably mountable to an end of the extension bar, including an extension bar connecting mechanism and a pulley wheel rotatably mounted within a pulley bracket; a cable assembly including a handle member, a cable guide having a mechanism for securing the cable guide to the back of the existing porch swing, and a cable having a first end secured to the handle member, a central section positionable through the cable guide mechanism and a second end split into two rope members, each rope member including a rope member attaching mechanism for attaching each rope mechanism to the back of the existing porch swing. In a preferred embodiment the swing mechanism further includes a cable length adjustment mechanism to allow the user to adjust the length of the cable member and thereby adjust the height of the handle member to a desired level.

In use, the extension bar is secured to a fixed surface such as the horizontal member of an A-frame swing support in a manner such that the pulley support end of the extension bar is positioned past the back support surface of the porch swing. The second end of the cable assembly is threaded over the pulley wheel, the cable guide mechanism is secured to the back of the porch swing and the rope members are secured to the porch swing at a location beneath and to either side of the guide mechanism. Use of two rope members positioned on either side of the cable guide mechanism creates two points of pulling force and minimizes the tendency of the porch swing to twist when the cable is pulled by grasping the handle member and pulling downward. It is preferred to include a cable directing loop adjacent to the end of the extension bar that is adapted to be secured to a fixed surface.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers wherein.

EXEMPLARY MODE FOR CARRYING OUT THE INVENTION

Figure 1:
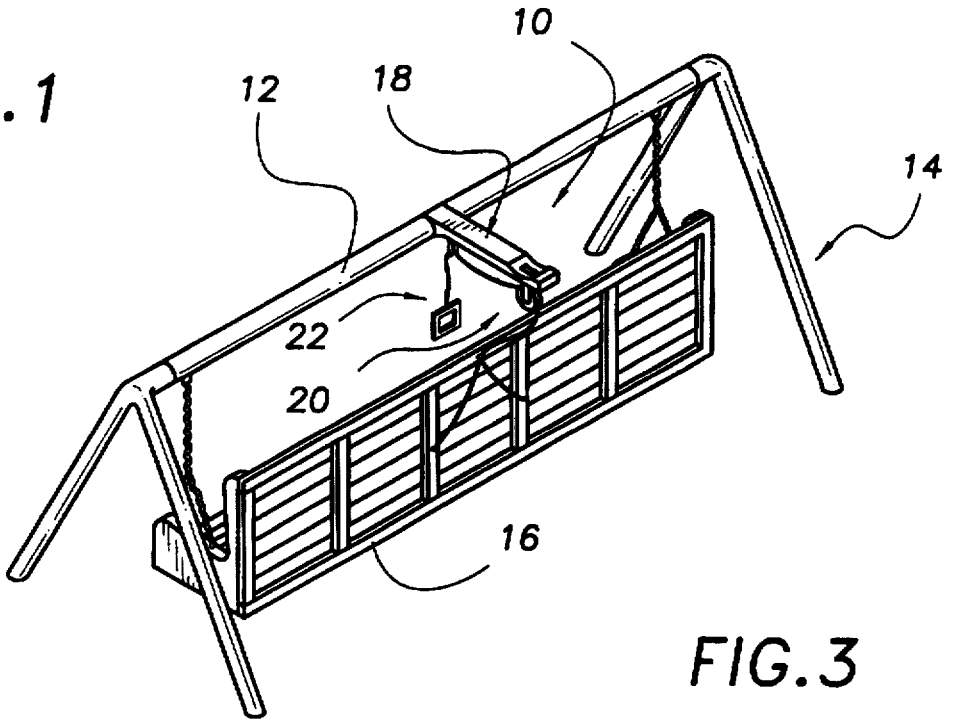
FIG. 1 is a perspective view of a representative porch swing hung from the horizontal beam of an A-frame support structure with an exemplary embodiment of the add-on hand-powered swing mechanism of the present invention installed in connection therewith.

FIG. 1 shows an exemplary embodiment of the add-on hand-powered swinging mechanism of the present invention, generally designated by the numeral 10, mounted to a horizontal support beam 12 of a representative A-frame support structure, generally designated by the numeral 14, that has a representative porch swing 16 suspended therefrom. Swinging mechanism 10 comprises an extension bar, generally designated 18; a pulley assembly, generally designated 20; and a cable assembly, generally designated 22.

Figure 2:
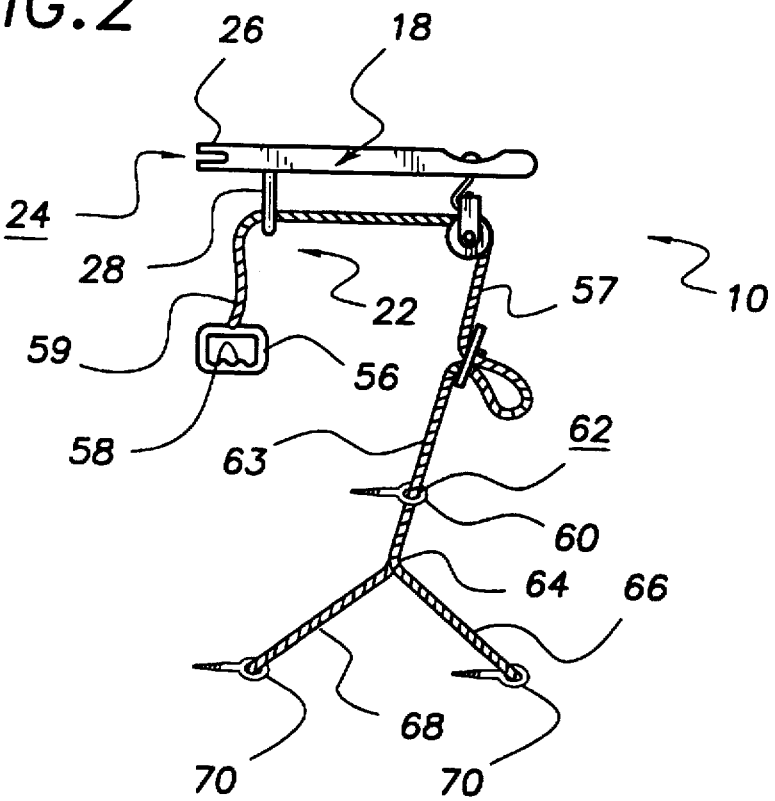
FIG. 2 is a side view of the exemplary add-on hand-powered swing mechanism of FIG. 1 showing the extension bar, the pulley assembly, the cable assembly and the cable length adjustment mechanism.
Figure 2A:
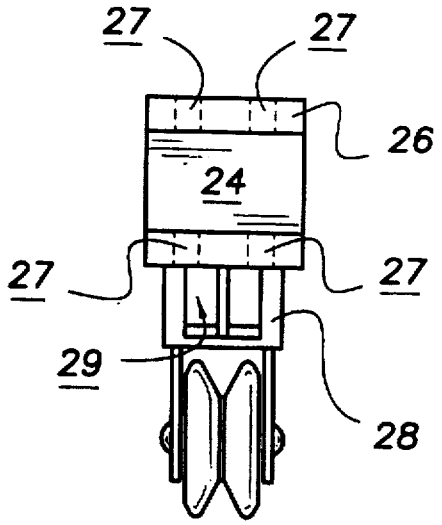
FIG. 2A is a front plan view of the extension bar and the pulley assembly showing the horizontal member receiving notch, the cable directing loop, and the extension bar mounting apertures.

With reference to FIG. 2, in this embodiment extension bar 18 is constructed from wood, however, other rigid materials such a metal and plastic are suitable. Extension bar 18 has a horizontal member receiving notch 24 formed in a first end 26 thereof. With reference to FIG. 2A, first end 26 is provided with a pair of extension bar mounting apertures 27 that are located on either side of horizontal member receiving notch 24. A cable directing loop 28 extends perpendicularly from a bottom surface of extension bar 18 and defines a cable threading aperture 29 through which the cable of cable assembly 22 is threaded.

Figure 2B:
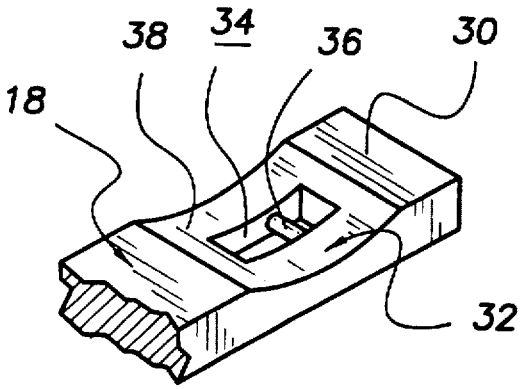
FIG. 2B is a detail perspective view of the pulley attachment end of the extension bar showing the pulley hanging bar and the recessed hanging bar access area.

With reference to FIG. 2B, a second end 30 of extension bar 18 has a pulley connection mechanism, generally designated 32, provided therein. Pulley connecting mechanism 32 includes a pulley hook receiving aperture 34, a pulley hanging bar 36 and a recessed hanging bar access area 38. Hook receiving aperture 34 is sized to allow the S-hook of the pulley assembly (described herein below) to be inserted therethrough and over pulley hanging bar 36. Recessed hanging bar access area 38 is recessed to allow easy access to the S-hook for removal from pulley hanging bar 36 when it is desired to detach pulley assembly 20 from extension bar 18.

Figure 3:
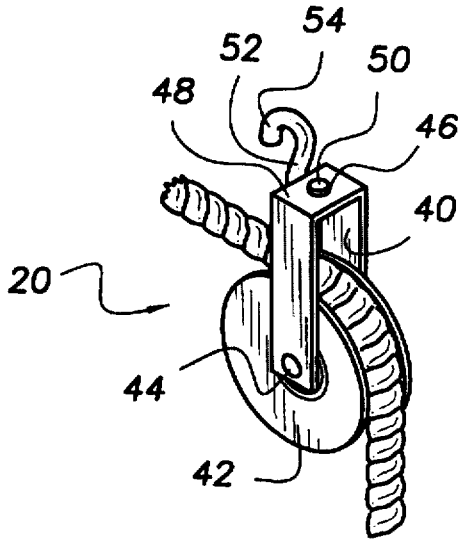
FIG. 3 is a perspective view of the exemplary pulley assembly showing the S-hook, the pulley bracket and the pulley wheel.

FIG. 3 shows pulley assembly 20 in isolation. Pulley assembly 20 includes a generally U-shaped pulley bracket 40 having a pulley wheel 42 rotatably mounted on an axle 44. A hook aperture 46 is provided through a cross bar 48 of pulley bracket 40. One end 50 of a conventional S-hook 52 is positioned through hook aperture 46. The other end 54 of S-hook 52 is positioned over pulley hanging bar 36 to attach pulley assembly 20 to extension bar 18.

With reference once again to FIG. 2, cable assembly 22 includes a plastic handle member 56, a cable 57, and a cable guide 60. Handle member 56 is secured to a first end 59 of cable 57 and includes a hand grip portion 58 that is contoured to receive the fingers of a user. Cable guide 60 consists of a conventional eye-bolt having an eye 62 through which a central portion 63 of cable 57 is slidably disposed during installation and a threaded portion 64 that is screwed into the back and center of the back rest support of porch swing 16 during installation. Cable 57 includes a second end 64 that is split into two rope members 66,68. Each rope member 66,68 terminates in a rope member attaching mechanism 70 that consists of an eye-bolt.

Figure 4:
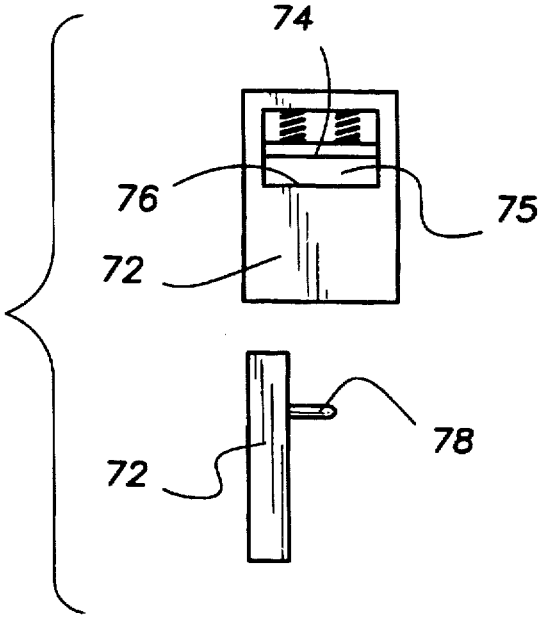
FIG. 4 is a plan front and side view of the cable length adjustment mechanism showing the spring loaded clamping jaws and the perpendicularly oriented finger grip.

Also shown in FIG. 2 is an optional exemplary cable length adjustment mechanism 72 that is used to allow the user to adjust the height of the handle to a desired level. FIG. 4 shows a front view of length adjustment mechanism 72 including a spring loaded clamping jaw 74 that is spring biased toward and against an anvil 76. Clamping jaw 74 is urged away from anvil 76 by applying a force to perpendicularly oriented finger grip 78 that is sufficient to create a gap 75 between clamping jaw 74 and anvil 76 of sufficient size to allow a section of cable 57 to be inserted therethrough. When finger grip 78 is released, clamping jaw 74 travels toward anvil 76 gripping cable 57 securely and reducing the effective length of cable 57 by the length of cable 57 extending through gap 75. Although the exemplary length adjustment mechanism 72 includes a spring biased clamping jaw 74, it should be understood that other mechanisms can be employed to reduce the effective length of cable 57 without departing from the spirit and scope of the invention taught herein. Use of exemplary swinging mechanism 10 is now described with general reference to FIGS. 1–4. Swinging mechanism 10 is installed on A-frame support 14 by positioning horizontal member receiving notch 24 over horizontal support member 12, drilling holes through horizontal support member 12 that are in registration with extension bar mounting apertures 27, inserting bolts through extension bar mounting apertures 27 and the drilled holes, placing nuts over the threaded ends of the bolts, and tightening the nuts until extension bar 18 is secured to horizontal support 12.

Once extension bar 18 is secured to horizontal support bar 12, pulley assembly 20 is connected to extension bar 18 by placing second end 54 of S-hook 52 over pulley hanging bar 36. Cable guide 60 is then screwed into the center back surface of the backrest portion of representative swing 16. The second end 64 of cable 57 is then sequentially threaded through cable directing loop 28, over pulley wheel 42, and through eye 62 of cable guide 60. The two rope members 66,68 are then each secured in the manner previously described. If desired, the position of handle member 56 can be adjusted by adjusting the length of cable 57 using cable length adjustment mechanism 72 as previously described. Operation of swing mechanism 10 is achieved by simply repeatedly pulling on handle member 56 to pull swing 16 backward and then allowing handle member 56 to travel upward unimpeded and thus allowing swing 16 to travel forward. Once swing 16 begins its rearward travel, the pulling sequence is repeated.

It can be seen from the preceding description that an add-on hand-powered swinging mechanism for a porch swing or the like has been provided that can be easily installed on an existing porch swing to allow the porch swing to be swung without requiring the use of the users feet and legs; that allows the user to swing the porch swing by pulling on a rope or cable; and that includes a cable length adjustment mechanism to allow the user to conveniently position a handle secured to the cable at a comfortable height.

It is noted that the embodiment of the add-on hand-powered swinging mechanism for a porch swing or the like described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An add-on hand-powered swinging mechanism for a porch swing or the like comprising:

an extension bar having a first extension bar end securable to a fixed surface adjacent said porch swing and a pulley connection mechanism at a second extension bar end;

a pulley assembly, detachably mountable to said second extension bar end, including an extension bar connecting mechanism and a pulley wheel rotatably mounted within a pulley bracket; and a cable assembly including a handle member, a cable guide having a mechanism for securing said cable guide to a back of said existing porch swing, and a cable having a first cable end secured to said handle member, a central cable section positionable through said cable guide mechanism and a second cable end split into two rope members, each rope member including a rope member attaching mechanism for attaching each rope mechanism to said back of said swing.

2. The add-on hand-powered swinging mechanism for a porch swing or the like of clam 1 wherein:

said extension bar includes a cable directing loop that extends perpendicularly from a bottom surface of said extension bar and defines a cable threading aperture through which said cable of said cable assembly is threaded.

3. The add-on hand-powered swinging mechanism for a porch swing or the like of claim 2 wherein:

said pulley connection mechanism including a pulley hook receiving aperture and a pulley hanging bar.

4. The add-on hand-powered swinging mechanism for a porch swing or the like of claim 3, wherein:

said extension bar end has a horizontal member receiving notch formed in said first extension bar end; said first extension bar end being provided with a pair of extension bar mounting apertures that are located on either side of said horizontal member receiving notch.

5. The add-on hand-powered swinging mechanism for a porch swing or the like of claim 3 wherein:

said pulley assembly includes a generally U-shaped pulley bracket having a pulley wheel rotatably mounted on an axle, a hook aperture provided through a cross bar of said pulley bracket, and an S-hook having a first S-hook end positioned through said hook aperture.

6. The add-on hand-powered swinging mechanism for a porch swing or the like of claim 3, further including:

a cable length adjustment mechanism securable to the cable assembly in a manner to allow a user to adjust the length of said cable member.

7. The add-on hand-powered swinging mechanism for a porch swing or the like of claim 2, wherein:

said extension bar has a horizontal member receiving notch formed in said first extension bar end; said first extension bar end being provided with a pair of extension bar mounting apertures that are located on either side of said horizontal member receiving notch.

8. The add-on hand-powered swinging mechanism for a porch swing or the like of claim 7 wherein:

said pulley assembly includes a generally U-shaped pulley bracket having a pulley wheel rotatably mounted on an axle, a hook aperture provided through a cross bar of said pulley bracket, and an S-hook having a first S-hook end positioned through said hook aperture.

9. The add-on hand-powered swinging mechanism for a porch swing or the like of claim 8, further including:

a cable length adjustment mechanism securable to the cable assembly in a manner to allow a user to adjust the length of said cable member.

10. The add-on hand-powered swinging mechanism for a porch swing or the like of claim 7, further including:

a cable length adjustment mechanism securable to the cable assembly in a manner to allow a user to adjust the length of said cable member.

11. The add-on hand-powered swinging mechanism for a porch swing or the like of claim 2 wherein:

said pulley assembly includes a generally U-shaped pulley bracket having a pulley wheel rotatably mounted on an axle, a hook aperture provided through a cross bar of said pulley bracket, and an S-hook having a first S-hook end positioned through said hook aperture.

12. The add-on hand-powered swinging mechanism for a porch swing or the like of claim 2, further including:

a cable length adjustment mechanism securable to the cable assembly in a manner to allow a user to adjust the length of said cable member.

13. The add-on hand-powered swinging mechanism for a porch swing or the like of claim 1 wherein:

said pulley connection mechanism including a pulley hook receiving aperture and a pulley hanging bar.

14. The add-on hand-powered swinging mechanism for a porch swing or the like of claim 1, wherein:

said extension bar has a horizontal member receiving notch formed in said first extension bar end; said first extension bar end being provided with a pair of extension bar mounting apertures that are located on either side of said horizontal member receiving notch.

15. The add-on hand-powered swinging mechanism for a porch swing or the like of claim 1, wherein:

said pulley assembly includes a generally U-shaped pulley bracket having a pulley wheel rotatably mounted on an axle, a hook aperture provided through a cross bar of said pulley bracket, and an S-hook having a first S-hook end positioned through said hook aperture.

16. The add-on hand-powered swinging mechanism for a porch swing or the like of claim 1, further including:

a cable length adjustment mechanism securable to the cable assembly in a manner to allow a user to adjust the length of said cable member.

17. The add-on hand-powered swinging mechanism for a porch swing or the like of claim 1 wherein:

said handle member includes a hand grip portion that is contoured to receive the fingers of a user.

18. The add-on hand-powered swinging mechanism for a porch swing or the like of claim 17 wherein:

said second extension bar end has a pulley connection mechanism including a pulley hook receiving aperture and a pulley hanging bar.

19. The add-on hand-powered swinging mechanism for a porch swing or the like of claim 18, wherein:

said extension bar has a horizontal member receiving notch formed in said first extension bar end; said first extension bar end being provided with a pair of extension bar mounting apertures that are located on either side of said horizontal member receiving notch.

20. The add-on hand-powered swinging mechanism for a porch swing or the like of claim 19 wherein:

said pulley assembly includes a generally U-shaped pulley bracket having a pulley wheel rotatably mounted on an axle, a hook aperture provided through a cross bar of said pulley bracket, and an S-hook having a first S-hook end positioned through said hook aperture.

* * * * *